United States Patent [19]

Eby et al.

[11] Patent Number: 4,509,570

[45] Date of Patent: Apr. 9, 1985

[54] ELASTIC TOP BAG

[76] Inventors: Jeffrey Eby, c/o George Spector, 3615 Woolworth Bldg., 233 Broadway; George Spector, 3615 Woolworth Bldg., 233 Broadway, both of New York, N.Y. 10007

[21] Appl. No.: 460,748

[22] Filed: Jan. 24, 1983

[51] Int. Cl.[3] ..... B65B 43/26

[52] U.S. Cl. ..... 141/390; 383/33; 248/97

[58] Field of Search ..... 150/DIG. 1, 52 R; 141/10, 316, 390; 220/400, 404, 18, 18.1, 1 T; 248/95, 97, 99; 383/33, 7, 43

[56] References Cited

U.S. PATENT DOCUMENTS

| | | | |
|---|---|---|---|
| 1,086,002 | 2/1914 | Stewart | 141/390 |
| 1,971,642 | 8/1934 | Champlin | 248/97 |
| 2,631,629 | 3/1953 | Lee | 383/43 |
| 3,905,406 | 9/1975 | Cruse | 141/390 |
| 4,140,257 | 2/1979 | Peterson | 220/404 X |
| 4,338,979 | 7/1982 | Dow | 220/404 X |

*Primary Examiner*—Stephen Marcus
*Assistant Examiner*—David Voorhees

[57] ABSTRACT

An elastic top trash bag is provided and consists of a trash bag having an opening at the top, an elastic band placed around the top of the trash bag, the trash bag having edges of the top folded over the elastic band and sealed forming a hem so that the elastic band is held within the hem, the hem serves to hold the trash bag in place around top of a receptacle when the hem is folded over the top of the receptacle and to close the trash bag automatically when the trash bag is removed from the receptacle.

1 Claim, 7 Drawing Figures

ELASTIC TOP BAG

BACKGROUND OF THE INVENTION

The instant invention relates generally to trash bags and more specifically it relates to an elastic top trash bag.

Frustration and aggravation is common to users of trash can liners, lawn bag liners and similar liners or bags in their current form. This is caused when the bag or liner fails to stay in place and falls down inside the container or falls away from the sides when items are placed inside. This situation is not desirable so accordingly it is in need of an improvement.

SUMMARY OF THE INVENTION

A principle object of the present invention is to provide an elastic top trash bag that has an elastic band as an integral part of the top of the trash bag to hold the trash bag in place around the top of a receptacle when folded over the outside of the container and to close the bag automatically when removed from the receptacle.

Another object is to provide an elastic top trash bag that eliminates the need for a separate apparatus to close the trash bag when full and ready to be discarded.

An additional object is to provide an elastic top trash bag that will increase the general efficiency and sanitation by preventing refuse from falling between the trash bag and the receptacle.

A further object is to provide an elastic top trash bag that has a frame member inside so that the trash bag can be supported in an open position to be filled without utilizing the receptacle.

A still further object is to provide an elastic top trash bag that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
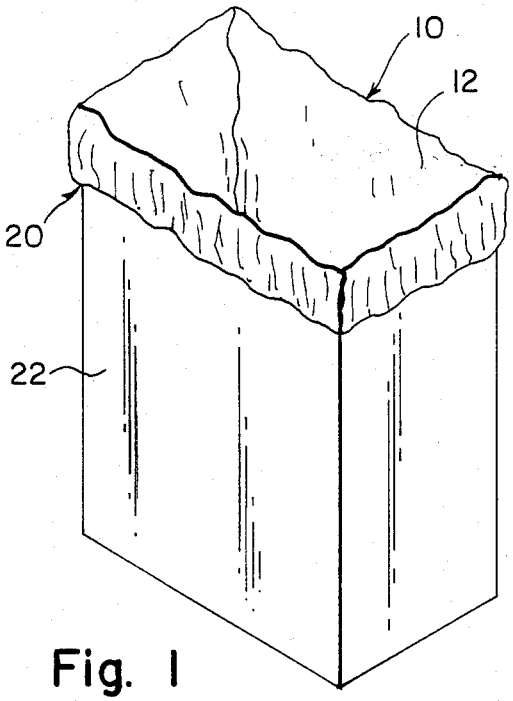
FIG. 1 is a perspective view of the invention in a receptacle.
Figure 2:
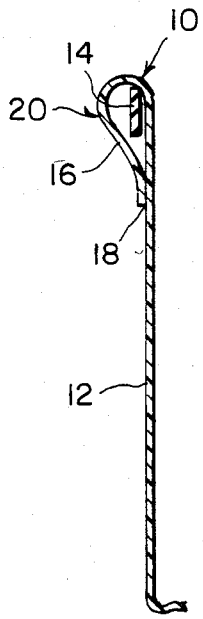
FIG. 2 is a cross sectional view through one side of the trash bag.
Figure 3:
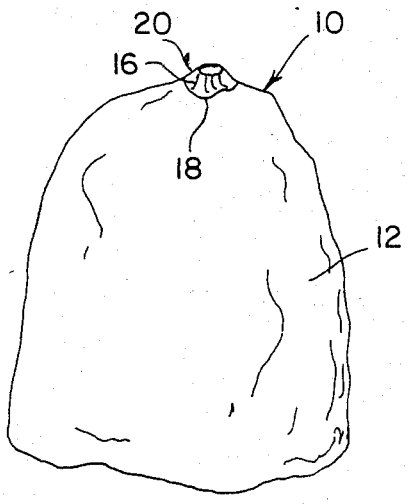
FIG. 3 is a perspective view of the trash bag full with top hem closed.

Turning now descriptively to the drawings, in which similar reference characters denote similar elements throughout the several views, FIGS. 1 through 3 illustrates an elastic top trash bag 10. As best seen in FIG. 2 the elastic top trash bag 10 consists of a trash bag 12 made out of plastic having an opening at the top. An elastic band 14 made out of rubber is placed around the top of the trash bag 12. The trash bag 12 has edges 16 on the top folded over the elastic band 14 and sealed at 18 forming a hem 20 so that the elastic band 14 is held within the hem 20.

The hem 20 serves to hold the trash bag 12 in place around top of a receptacle 22 when the hem 20 is folded over the top of the receptacle 22 as shown in FIG. 1. The hem 20 closes the trash bag 12 automatically when the trash bag 12 is removed from the receptacle 22 as shown in FIG. 3.

Figure 4:
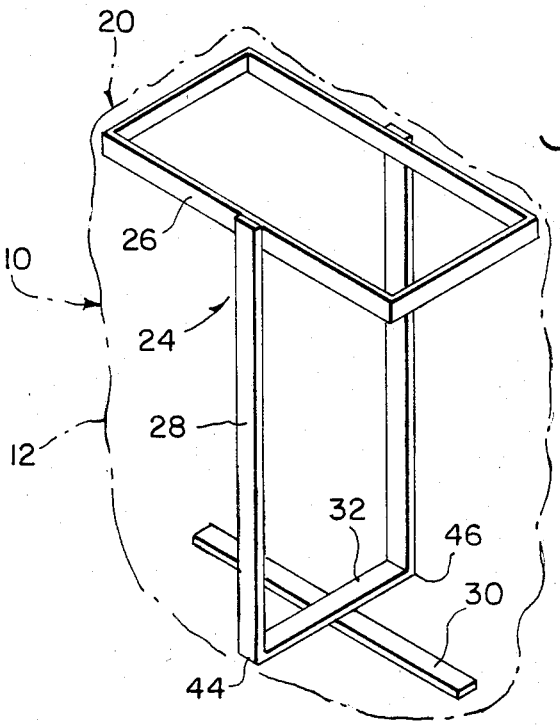
FIG. 4 is a perspective view of a modification showing frame members used within the trash bag.

FIG. 4 shows the elastic top trash bag 10 in phantom and a frame 24. The frame is made up of a rectangular top frame member 26, a U-shaped frame member 28 and a bar frame member 30.

The rectangular top frame member 26 holds the hem 20 in an open position. The U-shaped frame member 28 is placed within the trash bag 12 in a vertical position. The U-shaped frame member 28 is removably attached to an supports the rectangular top frame member 26. The bar frame member 30 is removably attached transverse to bottom 32 of the U-shaped frame member 28 so that the trash bag 12 can be supported in an open position to be filled without utilizing the receptacle 22.

Figure 5:
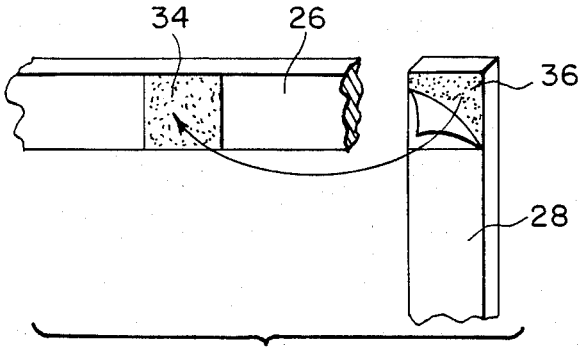
FIG. 5 is an exploded detail perspective view showing how the frame members are put together.

FIG. 5 shows the rectangular top frame member 26 and the U-shaped frame member 28 attached to each other with peel away adhesive areas 34 and 36 for easy assembly. The bar member 30 is attached to the bottom 32 of the U-shaped frame member in the same manner.

Figure 6:
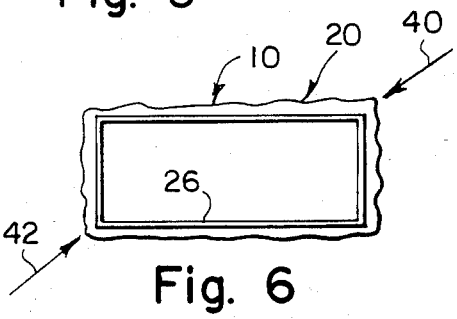
FIG. 6 is a top view of the top frame member in the trash bag.
Figure 7:
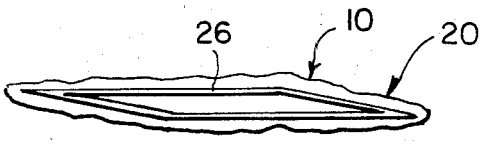
FIG. 7 is a top view similar to FIG. 6 but in a collapsed position.

The rectangular top frame member 26, the U-shaped frame member 28 and the bar frame member are made of durable hard plastic. FIGS. 6 and 7 shows the top frame member 26 in an open and closed position. When a person wants the top frame member 26 to become collapsible, pressure is placed at corners indicated by arrows 40 and 42 shown in FIG. 6. The U-shaped frame member 28 is also collapsible at its corners 44 and 46 for storage when not in use.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An elastic top trash bag which comprises:

(a) a trash bag having an opening at the top;

(b) an elastic band placed around the top of the trash bag, the trash bag having edges of the top folded over the elastic band and sealed forming a hem so that the elastic band is held within the hem, the hem serves to hold the trash bag in place around top of a receptacle when the hem is folded over the top of the recepticle and to close the trash bag automatically when the trash bag is removed from the recepticle, in combination with removeable collapsible frame for internally supporting the bag in open position, said means having portions detachable for purposes of being collapsed wherein the trash bag is made out of plastic and the elastic band is made out of rubber, said frame further comprises:

(a) a rectangular top frame member to hold the hem in an open position;

(b) a U-shaped frame member that is placed within the trash bag in a vertical position, the U-shaped frame member is removeably attached to and supports the rectangular top frame member; and (c) a bar frame member removeably attached transverse to bottom of the U-shaped frame member so that the trash bag can be supported in an open position to be filled without utilizing the receptacle wherein the rectangular top frame member, the U-shaped frame member and bar frame member are made of durable hard plastic and are collapsible for storage when not in use wherein the rectangular top frame member, the U-shaped frame member and the bar frame member are attached to each other with peel away adhesive for easy assembly.

* * * * *